United States Patent [19]

Lonardi

[11] Patent Number: 4,986,516

[45] Date of Patent: Jan. 22, 1991

[54] SEALING SHUTTER FOR A SHAFT FURNACE

[75] Inventor: Emile Lonardi, Basscharage, Luxembourg

[73] Assignee: Paul Wurth S.A., Luxembourg, Luxembourg

[21] Appl. No.: 447,992

[22] Filed: Dec. 8, 1989

[30] Foreign Application Priority Data

Dec. 30, 1988 [LU] Luxembourg ..... 87419

[51] Int. Cl.[5] ..... C21B 7/08

[52] U.S. Cl. ..... 266/87; 266/199

[58] Field of Search ..... 266/87, 272, 197, 199

[56] References Cited

U.S. PATENT DOCUMENTS

| | | | |
|---|---|---|---|
| 1,746,705 | 2/1930 | Koppers | 266/199 |
| 3,732,993 | 5/1973 | Csapo | 266/199 |
| 4,216,946 | 8/1980 | Sieweke et al. | 266/197 |

*Primary Examiner*—S. Kastler

*Attorney, Agent, or Firm*—Fishman, Dionne & Cantor

[57] ABSTRACT

A shutter for sealing a flow-off orifice of charging lock for charging a shaft furnace is disclosed. The shutter includes a soft peripheral gasket and is movable between a closed position, in which the gasket is laid against an annular seal surrounding a passage orifice, and an open position in which the gasket is set apart from the passage orifice. In order to reduce the thermal stresses on the gasket, the seat has an internal channel connected to a circuit of a temperature regulating fluid.

8 Claims, 1 Drawing Sheet

SEALING SHUTTER FOR A SHAFT FURNACE

TECHNICAL FIELD

The present invention relates to shaft furnaces and more particularly to sealing shutters for shaft furnaces.

BACKGROUND

Shaft furnaces, especially blast furnaces, are charged via a lock which is alternatively put in communication with the atmosphere during its filling and with the interior of the furnace during the flow-off of the charging material. For this purpose, the flow-off orifice and the charging orifice of the lock are equipped with sealing shutters. A sealing shutter typically includes a soft peripheral gasket and is movable between a first position, wherein the gasket is laid against an annular seat surrounding the charging orifice, and a second position wherein the gasket is set apart from the annular seat. A flow-off orifice sealing shutter is necessarily exposed to the high temperatures prevailing inside the furnace. These high temperatures quickly subject the gasket of such a shutter to fatigue, particularly because these gaskets are made of a soft material which is relatively vulnerable to mechanical wear and which consequently has to be replaced frequently.

Moreover, when, depending on the operation of the furnace, the temperature in the chamber is low and the seat is cooled below the condensation point of the hot wet gases, the moisture of these condenses on the seat, thus causing the deposit of dust which forms a crust there when the temperature rises again. These crusts reduce the sealing effect and accelerate the wear of the gaskets. U.S. Pat. No. 4,216,946, the disclosure of which is incorporated herein by reference, has proposed reducing this risk of the formation of a crust on the seat by heating it by means of an electrical resistor. Nevertheless, this measure does not make it possible to solve the problem of the overheating of the gasket and also does not protect it in its open position.

SUMMARY OF THE INVENTION

The object of the present invention is to provide a sealing shutter which does not experience the above mentioned disadvantages as a result of a regulation of its temperature.

To achieve this objective, the sealing shutter provided by the present invention is characterized, in its preferred embodiment, in that the seat has an internal annular channel connected to a circuit of a temperature regulating fluid.

According to an advantageous embodiment, a dummy seat against which the shutter is laid in its siding position and which likewise possesses an internal channel connected to the said temperature regulating fluid circuit.

DETAILED DESCRIPTION OF THE DRAWINGS

Figure 1:
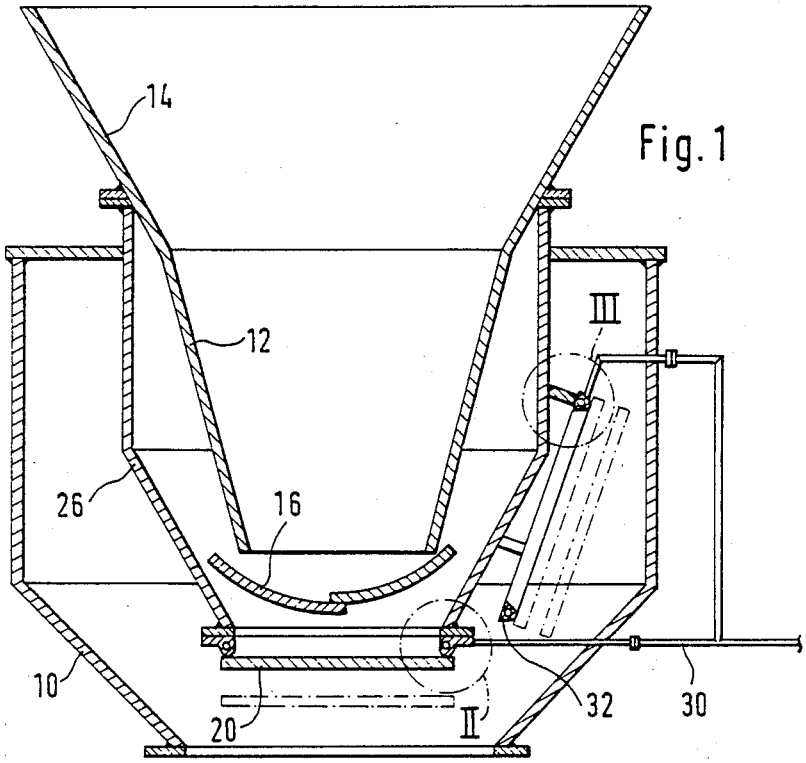
FIG. 1 shows a general view, in vertical section, of a valve cage of a charging installation of a shaft furnace.

FIG. 1 shows a valve cage 10 arranged round a flow-off neck 12 of a lock 14, of which the flow of charging material towards the furnace (not shown) located underneath the cage 10 is regulated by means of a proportioning valve 16. A stationary support 26 surrounds the flow-off neck 12. An annular seat 24 is secured to a stationary support 26.

Figure 2:
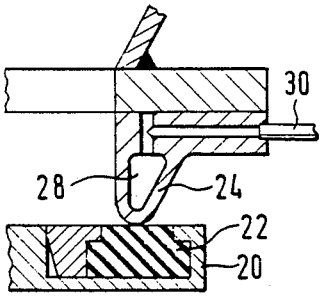
FIG. 2 shows an enlarged view of the inset designated by II in FIG. 1.

The sealing between the lock 14 and the interior of the furnace is ensured by means of a sealing shutter, the details of which appear in FIG. 2. The shutter 20 is provided with an annular gasket 22 of soft material capable of standing a particular temperature. The shutter 20 has a closed position in which the annular gasket 22 is laid against an annular seat 24 and a closed position in which the annular gasket 22 is set apart from the annular seat 24.

According to the present invention, the seat 24 has an internal channel 28 which is connected by means of a pipe 30 to a circuit, via which a gas or a liquid is circulated in the channel 28 at a predetermined temperature. The temperature of this fluid, which can be a gas or a liquid, will be selected according to the operating characteristics of the furnace. At all events, this fluid will some times have a cooling effect on the two seats and on the gasket and some times a heating effect. The heating of the seats will take place essentially when the ambient temperature falls below the condensation threshold, while cooling will occur essentially when the ambient temperature approaches the limiting temperature of the gasket. As an example, this temperature is of the order of 80° to 100° C., according to the operating characteristics of the furnace. This liquid will therefore have a cooling effect on the gasket 22 when the ambient temperature is higher than the temperature of this fluid and a heating effect when the ambient temperature is below the temperature of the fluid, in order to prevent deposits of dust both on the seat 24 and on the gasket 22 as a result of condensation.

Figure 3:
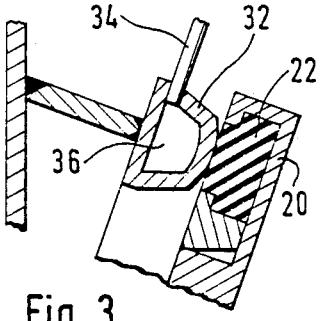
FIG. 3 shows an enlarged view of the inset designated by III in FIG. 1.

To reduce the thermal stresses and the risks of soiling of the gasket 22 when the shutter is in the open position, according to an advantageous embodiment of the present invention there is a dummy seat 32 (see FIGS. 1 and 3) on the lateral side of the support 26 against which the shutter 20 is laid when it is in the open position during the charging of the furnace. This dummy seat 32 likewise has an internal channel 36 connected to the same circuit as the seat 24 by means of a pipe 34. The effect of the fluid in this circuit is therefore likewise exerted on the gasket 22 when the shutter is in its siding position.

Because the dummy seat 32 does not perform a sealing function with the gasket 22 when the shutter 20 is in the siding position, its form can be designed so that its contact surface with the gasket 22 is larger than on the seat 24, thereby allowing better thermal transmission between the seat 32 and the gasket 22.

Moreover, the impression made by the seat 32 in the gasket 22 will be less deep because the point force will be lower in view of the larger surface, and besides the impression will not correspond to that made by the seat 24.

Another advantage of the dummy seat 32 is that the gasket 22 of the shutter 20 is no longer exposed to the ambient gases in the open position, thereby naturally reducing the deposits of dust.

Another advantage of the liquid cooling is that there is no need for a cooling by inert gas, thus reducing the operating costs.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An apparatus for sealing a flow-off orifice of a charging lock for charging a shaft furnace, comprising:

a first annular seat circumscribing the orifice;

an annular internal channel within the first annular seat;

means for circulating a temperature regulating fluid through the channel to regulate the temperature of the first annular seat;

a shutter for sealing the orifice;

an annular gasket secured to a surface of the shutter;

said shutter having a closed position in which the annular gasket is disposed in contact with the annular seat to seal the orifice and an open position in which the annular gasket is set apart from the annular seat.

2. An apparatus according to claim 1, further comprising:

a second annular seat secured at a position near the orifice so that the annular gasket is disposed against the second annular seat when the shutter is in the open position; and means for regulating the temperature of the second annular seat.

3. The apparatus of claim 2, wherein the means for regulating the temperature of the second annular seat comprises an annular channel within the second annular seat and means for circulating a temperature regulating fluid through the channel.

4. An apparatus according to claim 2, wherein the first annular seat has a first contact surface area for contacting the annular gasket, the second annular seat has a second contact surface area for contacting the annular gasket, and the second contact surface area is larger than the first contact surface area.

5. An apparatus for charging a shaft furnace, said furnace having an open furnace head, comprising:

charging lock means for directing a stream of charging material through a flow-off orifice into the furnace;

a first annular seat circumscribing the orifice;

an annular internal channel within the first annular seat;

means for circulating a temperature regulating fluid through the channel to regulate the temperature of the first annular seat;

a shutter for sealing the orifice;

an annular gasket secured to a surface of the shutter;

said shutter having a closed position in which the annular gasket is disposed in contact with the annular seat to seal the orifice and an open position in which the annular gasket is set apart from the annular seat.

6. An apparatus according to claim 5, further comprising:

support means for securing the charging lock means to the head of the shaft furnace, a second annular seat secured to the support means so that the annular gasket is disposed against the second annular seat when the shutter is in the open position; and means for regulating the temperature of the second annular seat.

7. The apparatus of claim 6, wherein the means for regulating the temperature of the second annular seat comprises an annular channel within the second annular seat and means for circulating a temperature regulating fluid through the channel.

8. An apparatus according to claim 6, wherein the first annular seat has a first contact surface area for contacting the annular gasket, the second annular seat has a second contact surface area for contacting the annular gasket, and the second contact surface area is larger than the first contact surface area.

* * * * *